US006637390B1

(12) United States Patent
Dauer et al.

(10) Patent No.: US 6,637,390 B1
(45) Date of Patent: Oct. 28, 2003

(54) APPARATUS AND METHOD FOR MEASURING CAM PHASER LOCKING PIN POSITION

(75) Inventors: Kenneth J. Dauer, Avon, NY (US); David J. Trapasso, Bloomfiled, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/153,989

(22) Filed: May 23, 2002

(51) Int. Cl.[7] ..... F01L 1/34

(52) U.S. Cl. ..... 123/90.17; 123/90.15; 123/90.27; 123/90.31; 251/12; 464/160

(58) Field of Search ..... 123/90.15, 90.17, 123/90.27, 90.31; 251/12; 464/1, 2, 160

(56) References Cited

U.S. PATENT DOCUMENTS 5,209,202 A * 5/1993 Maurer et al. ..... 123/414
5,522,352 A * 6/1996 Adachi et al. ..... 123/90.15
5,715,780 A * 2/1998 Haller ..... 123/90.17
6,257,186 B1 * 7/2001 Heer ..... 123/90.17

* cited by examiner

*Primary Examiner*—Thomas Denion
*Assistant Examiner*—Ching Chang
(74) *Attorney, Agent, or Firm*—Patrick M. Griffin

(57) ABSTRACT

A vane-type cam phaser wherein a realtime method of measuring the axial position of the phaser's locking pin is provided. A magnet is fixed to the nose portion of the locking pin. A Hall-effect sensor is attached to the stator of the phaser in proximity to the magnet. As the locking pin moves through its range of travel, the magnet moves either toward or away from the sensor resulting in a proportional increase or decrease in sensor output voltage. By reading the voltage output, the axial position of the locking pin can be determined.

13 Claims, 3 Drawing Sheets

APPARATUS AND METHOD FOR MEASURING CAM PHASER LOCKING PIN POSITION

TECHNICAL FIELD

The present invention relates to cam phasers for altering the phase relationship between valve motion and piston motion in reciprocating internal combustion engines; more particularly, to cam phasers having a vaned rotor rotatably disposed in an internally-lobed stator wherein the rotor and stator can be mechanically locked together by a locking pin; and most particularly to an apparatus and method for accurately measuring the axial position of the locking pin within its range of travel.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds. Typically, a cam phaser employs a first element driven in fixed relationship to the crankshaft and a second element adjacent to the first element and mounted to the end of the camshaft in either the engine head or block. A cam phaser is commonly disposed at the camshaft end opposite the engine flywheel. The first element is typically a cylindrical stator mounted inside a crankshaft-driven gear or pulley, the stator having a plurality of radially-disposed inwardly-extending spaced-apart lobes and an axial bore. The second element is a vaned rotor mounted to the end of the camshaft through the stator axial bore and having vanes disposed between the stator lobes to form actuation chambers therebetween such that limited relative rotational motion is possible between the stator and the rotor. Such a phaser is known in the art as a vane-type cam phaser.

The disposition of the rotor in the stator forms a first, or timing-advancing, array of chambers on first sides of the vanes and a second, or timing-retarding, array of chambers on the opposite sides of the vanes. The apparatus is provided with suitable porting so that hydraulic fluid, for example, engine oil under engine oil pump pressure, can be brought to bear controllably on opposite sides of the vanes in the advancing and retarding chambers. Control circuitry and valving, commonly a multiport spool valve, permit the programmable addition and subtraction of oil to the advance and retard chambers to cause a change in rotational phase between the stator and the rotor, in either the rotationally forward or backwards direction, and hence a change in timing between the pistons and the valves.

Under conditions of low engine oil pump pressure, such as during startup, it is desirable to mechanically lock the rotor and stator together in a default mode to prevent unwanted relative angular movement of the rotor/stator when the pump pressure is not high enough to reliably position the rotor relative to the stator. This is typically accomplished by a hydraulically activated locking pin disposed in the rotor and positioned parallel to the rotational axis of the phaser. In the default position, when the rotor and stator are locked together, a locking pin spring biases the cylindrical locking pin outward to engage a pin bore disposed in the stator. When the oil pump pressure reached a pre-determined level, the hydraulic force of the oil causes the locking pin to retract from the pin bore and into the rotor thereby decoupling the rotor from the stator and permitting cam shaft phasing to occur. When the rotor and stator are mechanically locked together in the default mode, the torsional forces applied to the stator by the engine crankshaft are transferred to the rotor/camshaft via lateral loading of the locking pin in the pin bore.

It is desirable for the pin to be retracted from the coupled mode in a predictable manner to assure that the decoupling event occurs precisely when needed. That is, when a predetermined oil pressure is reached after engine start-up. Therefore, during development and testing of the cam phaser, it is desirable to accurately measure the actual axial position of the locking pin relative to oil pump pressure in order, for example, to calibrate the locking pin spring. This measurement is difficult to obtain because the locking pin itself is buried inside the cam phaser and rotates with the cam shaft. Moreover, since space in the area of the cam phaser is limited, there is very little room to mount measuring equipment that could accurately monitor the axial position of the locking pin.

What is needed is in the art is a method of accurately measuring the axial position of the cam phaser locking pin, during "real-time" engine operation, to determine pin position relative to oil pump pressure exerted on the locking pin.

SUMMARY OF THE INVENTION

The present invention is directed to a vane-type camshaft phaser wherein a locking pin assembly, including a locking pin, bushing and spring, is disposed between a rotor and a stator of the phaser to selectively couple the rotor and stator together. The invention allows the axial position of the locking pin to be accurately determined through its entire range of travel by the use of a Hall-effect sensor. A permanent magnet is secured to the nose portion of the locking pin and a sensor is secured to the floor of the mating pin bore. By measuring the voltage output of the Hall-effect sensor as the magnet moves away from the sensor, the axial position of the locking pin can be determined.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 2:
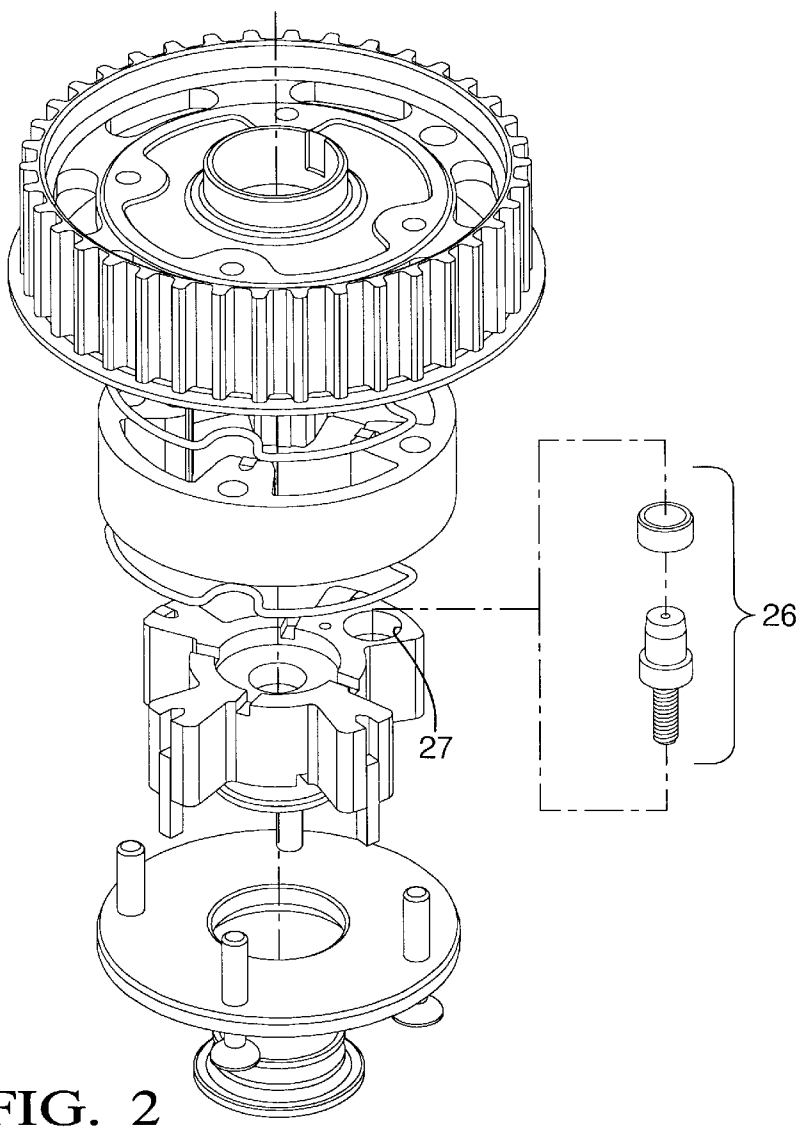
FIG. 2 is an exploded isometric view of a the vaned cam phaser of FIG. 1, looking from the back end.
Figure 1:
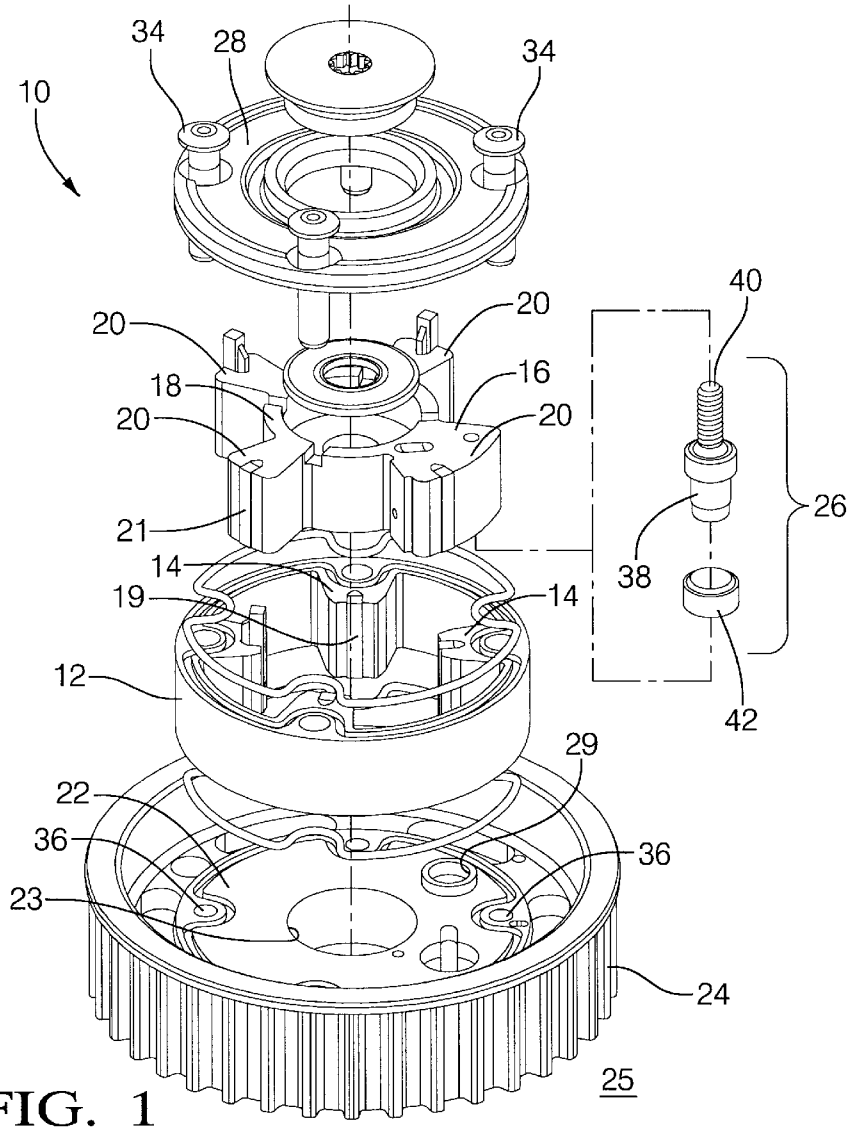
FIG. 1 is an exploded isometric view of a vaned cam phaser.
Figure 3:
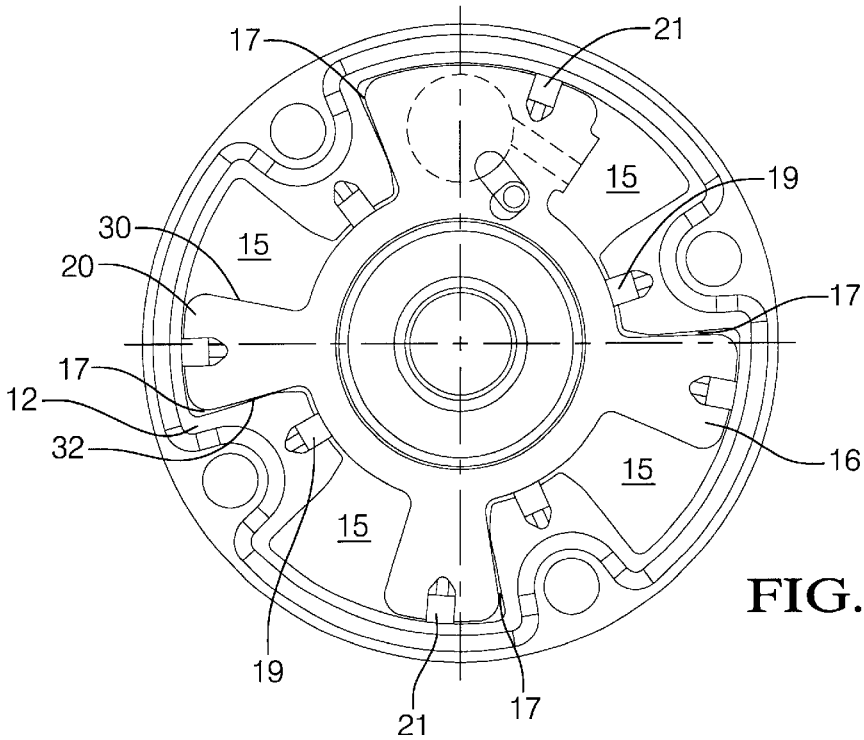
FIG. 3 is an axial view showing the rotor assembled into the stator.

Referring to FIGS. 1–3, vane-type cam phaser 10 includes a stator 12 having a plurality of inwardly-extending lobes 14, and a rotor 16 having a cylindrical hub 18 and a plurality of outwardly-extending vanes 20. As best shown in FIG. 3, when rotor 12 is assembled into stator 16, a plurality of timing-advancing chambers 15 and timing-retarding chambers 17 are formed between the rotor vanes and the stator lobes. Axially-extending lobe seals 19 and vane seals 21 prevent hydraulic leakage between the chambers. Referring again to FIG. 1, back plate 22, which seals the back side of stator 12, rotor 16, and the plurality of chambers 15,17 is attached to sprocket 24 for being rotationally driven, as by a timing chain or ribbed belt, from a crankshaft sprocket or gear in known fashion. Bore 23 in back plate 22 typically is receivable of the outer end of an engine camshaft (not shown) of internal combustion engine 25 on which phaser 10 may be thus mounted in known fashion. Opposite back plate 22 is a cover plate 28 for sealing the front side of the phaser hydraulics analogously to back plate 22. Bolts 34 extend through cover plate 28 and stator 12 and are secured into threaded bores 36 in back plate 22. The assembled cover plate, stator, and back plate define a unitized housing wherein rotor 16 may rotate through an axial angle sufficient to advance or retard the opening of engine valves through a predetermined angular range, typically about 30°. An actuable locking pin assembly 26, comprising pin 38, spring 40, and bushing 42, disposed in recess 27 (FIG. 2) in a vane of rotor 16 may be extended at certain times in the cam phaser operation, such as during engine start-up, to engage bore 29 in back plate 22 for preventing relative rotation between the rotor and stator. When the oil pump pressure reaches a pre-determined level, the hydraulic force of the oil causes locking pin 38 to retract from its engagement with bore 29, against the force of spring 40, and into rotor 12 thereby mechanically decoupling the rotor from the stator and permitting cam shaft phasing to occur. When the oil pump pressure falls below a predetermined level (such as during start-up), spring 40 biases locking pin toward back plate 22 to engage bore 29. Cam phaser 10 is provided with suitable and separate porting so that engine oil, under engine oil pump pressure, can be brought to bear controllably on either side 30 or side 32 of vanes 20 to rotationally advance or retard the rotor by directing oil into either advancing chambers 15 or retarding chambers 17 (FIG. 3). Suitable porting is also provided to communicate pressurized engine oil to the locking pin.

Figure 4:
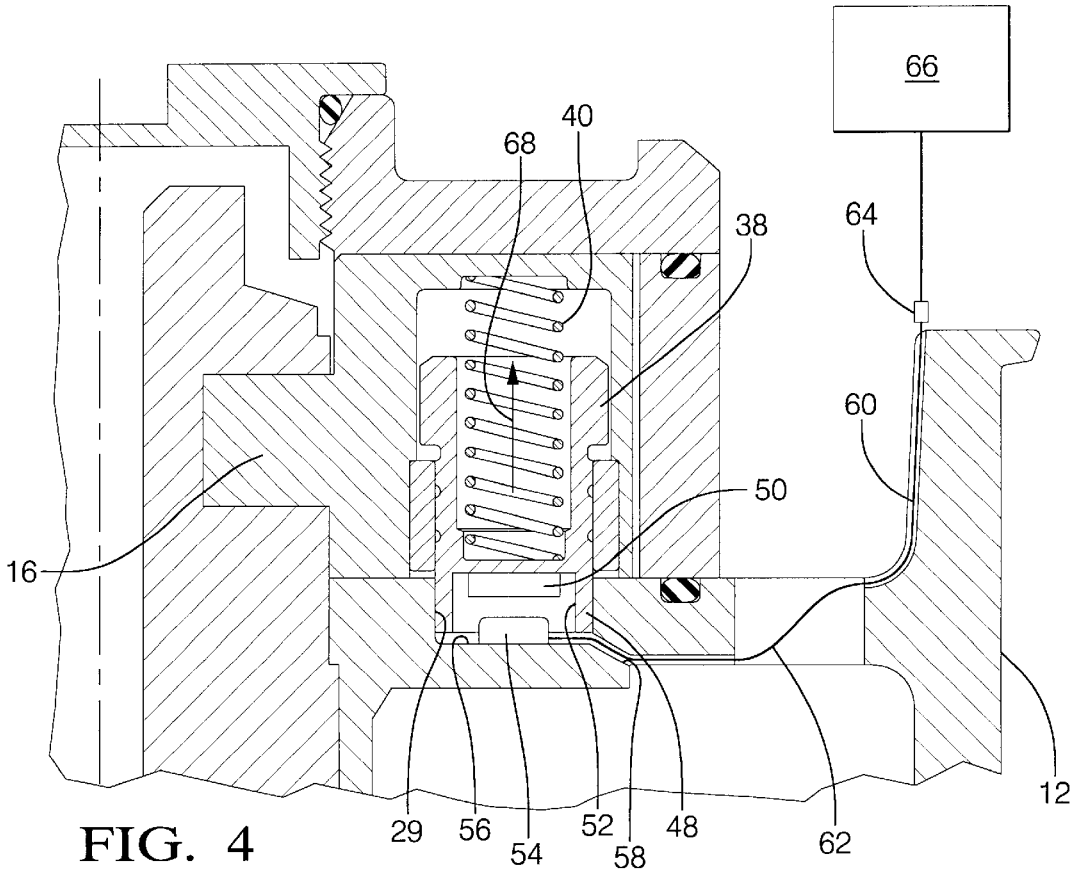
FIG. 4 is a side cross-sectional view of the locking pin mechanism of the present invention.

FIG. 4 is a cross-section view of rotor 16, stator 12 and locking pin assembly 26, with pin 38 in its locking position, and shows the preferred embodiment of the invention. Nose 48 of pin 38 defines bore 52 for receiving permanent magnet 50. Permanent magnet 50 is secured in place, for example, by an epoxy adhesive or other bonding agent. Hall-effect sensor 54 (such as the ratiometric linear sensor, model number A3515LUA, made by Allegro Microsystems of Worcester, Mass.), is positioned within the magnetic field of magnet 50 and is secured to floor 56 of pin recess 29 also, for example, by an epoxy adhesive or other bonding agent. Passage 58 and channel 60 are provided in stator 12 for receiving sensor wires 62. Wires 62 terminate at juncture 64 where an electrical connection is made with a slip ring assembly or the like, known in the art, for further connection with outside measuring device 66.

In use, Hall-effect sensor 54 provides a voltage output proportional to the magnetic field measured from magnet 50. Sensor 54 has a nominal voltage output of, for example, 2.5 v when the sensor is not subjected to the magnetic field of the magnet. In the cam phaser "locked" position shown in FIG. 4, pin 38 is fully engaged in pin bore 29, and magnet 50 is closest to sensor 54. Hence, in the pin position shown, the greatest change from the nominal voltage output would be measured by device 66. As pin 38 retracts from bore 29 in the direction shown by arrow 68, the magnetic field encompassing sensor 54 becomes less concentrated causing a proportional decrease (or increase depending on the relative polarities of the magnet and sensor) in the sensor's output voltage measured by device 66. Thus, there is a measurable and predictable change in output voltage as the locking pin moves away from it fully engaged position.

Figure 5:
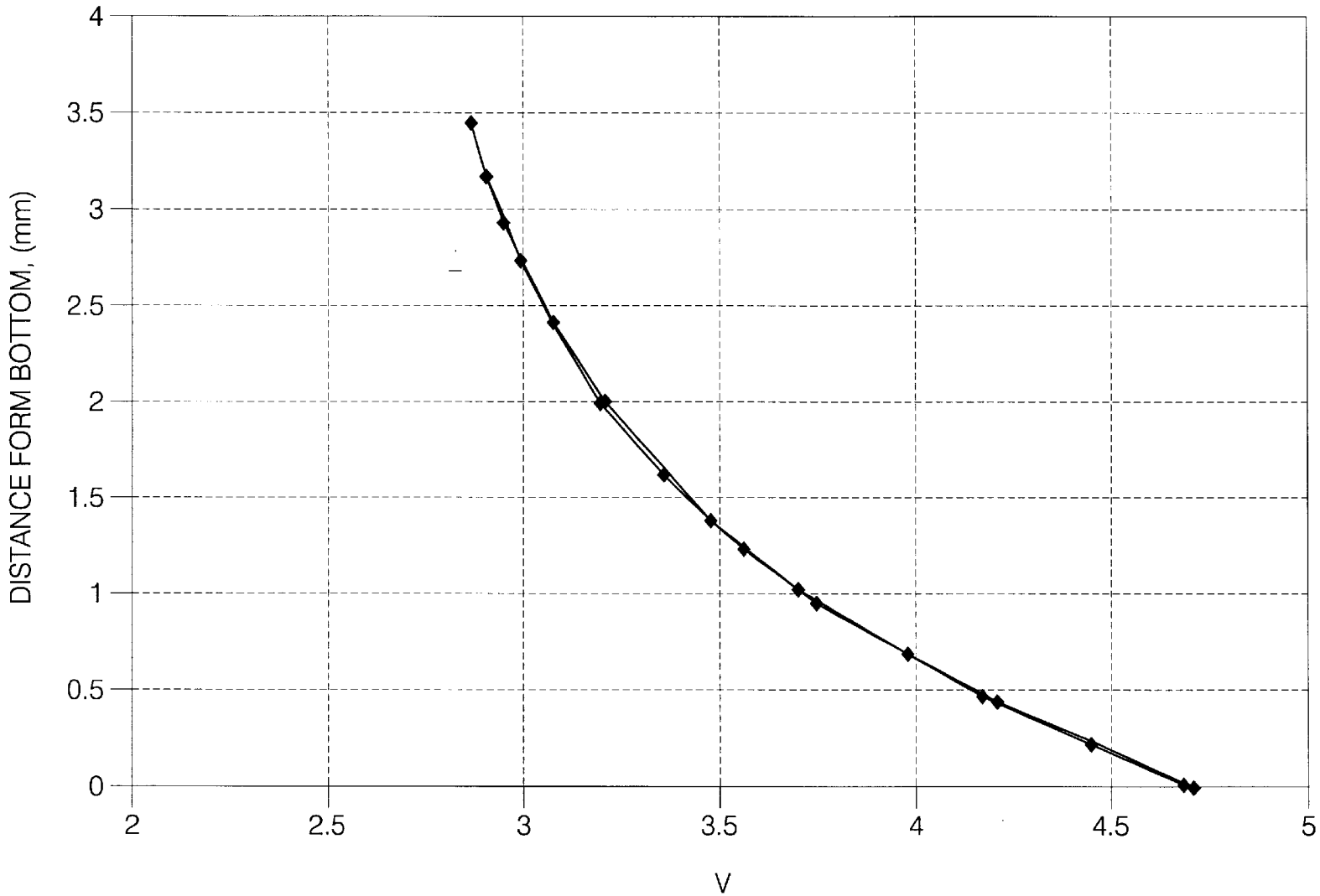
FIG. 5 is a plot showing the correlation between the measured output voltage of the sensor and the axial position of the locking pin.

FIG. 5 shows the relationship of measured voltage output of sensor 54 and the axial position of pin 38, as the locking pin moves away from it fully engaged position. As can be seen, by measuring the output voltage of sensor 54, the axial position of locking pin 38 within its range of travel can be accurately determined.

In the embodiment shown, magnet 50 is mounted in the lower portion of the locking pin and sensor 54 is mounted on the floor of bore 29. However, it is understood that the magnet and/or sensor can be mounted anywhere as long as the magnet is in continuous magnetic communication with the sensor.

The foregoing description of the invention, including a preferred embodiment thereof, has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An apparatus for measuring the axial position of a locking pin of a cam phaser, said cam phaser having a unitized housing including a lobed stator and a vaned rotor disposed within the stator; said apparatus comprising:

a) a locking pin assembly disposed in said rotor for selectively coupling said rotor and stator together wherein said locking pin assembly includes said locking pin and a magnet secured to said pin;

b) a sensing means secured in a pin bore in said stator for sensing a magnetic field of said magnet and in continuous magnetic communication with said magnet; and c) a means for reading an electrical output of said sensing means through a range of travel of said locking pin.

2. An apparatus in accordance with claim 1, wherein said magnet is secured to a nose portion of said locking pin.

3. An apparatus in accordance with claim 1, wherein said magnet is a permanent magnet.

4. An apparatus in accordance with claim 1, wherein said sensing means is a Hall-effect sensor.

5. An apparatus in accordance with claim 4, wherein said sensor is secured to a floor of said pin bore.

6. An internal combustion engine comprising:

a cam phaser having a unitized housing including a lobed stator and a vaned rotor disposed within the stator;

a locking pin assembly disposed in said rotor for selectively coupling said rotor and stator together wherein said locking pin assembly includes a locking pin and a magnet secured to said pin;

a sensing means disposed in said stator for sensing a magnetic field of said magnet and in continuous magnetic communication with said magnet; and a means for reading an electrical output of said sensing means through a range of travel of said locking pin.

7. An engine in accordance with claim 6, wherein said magnet is secured to a nose portion of said locking pin.

8. An engine in accordance with claim 6, wherein said magnet is a permanent magnet.

9. An engine in accordance with claim 6, wherein said sensing means is a Hall-effect sensor.

10. An engine in accordance with claim 9, wherein said sensor is disposed in a pin bore of said stator.

11. A method of measuring the axial position of a cam phaser locking pin comprising the steps of:

attaching a magnet to the locking pin;

affixing a sensing means for sensing the magnetic field of said magnet, fixedly positioned with respect to the locking pin, and in continuous magnetic communication with said magnet through a range of travel of said locking pin; and determining the position of the locking pin by measuring a voltage output of the sensing means.

12. A method of measuring in accordance with claim 1, wherein the attaching step includes attaching said magnet to a nose portion of said locking pin.

13. A method of measuring in accordance with claim 11, wherein the affixing step includes affixing said sensing means to a stator of said cam phaser.

* * * * *